US009631281B2

(12) United States Patent
Wissing

(10) Patent No.: US 9,631,281 B2
(45) Date of Patent: Apr. 25, 2017

(54) PROCESSES FOR PRODUCING A MULTILAYER COATING

(71) Applicant: AXALTA COATING SYSTEMS IP CO., LLC, Wilmington (DE)

(72) Inventor: Klaus Wissing, Haan (DE)

(73) Assignee: AXALTA COATING SYSTEMS IP CO., LLC, Wilmington, DE (US)

( * ) Notice: Subject to any disclaimer, the term of this patent is extended or adjusted under 35 U.S.C. 154(b) by 151 days.

(21) Appl. No.: 14/560,372

(22) Filed: Dec. 4, 2014

(65) Prior Publication Data

US 2016/0160356 A1 Jun. 9, 2016

(51) Int. Cl.

| | |
|---|---|
| ***C23C 22/36*** | (2006.01) |
| ***C23C 28/00*** | (2006.01) |
| ***C23C 22/82*** | (2006.01) |
| ***C23C 22/73*** | (2006.01) |
| ***C23C 22/83*** | (2006.01) |
| *B05D 7/00* | (2006.01) |

(52) U.S. Cl.

CPC ..... *C23C 22/361* (2013.01); *C23C 22/73* (2013.01); *C23C 22/82* (2013.01); *C23C 22/83* (2013.01); *C23C 28/00* (2013.01); *B05D 7/51* (2013.01); *B05D 7/52* (2013.01); *B05D 2202/00* (2013.01)

(58) Field of Classification Search

None

See application file for complete search history.

(56) References Cited

U.S. PATENT DOCUMENTS

| | | | | |
|---|---|---|---|---|
| 4,181,539 | A * | 1/1980 | Murakami | C23C 22/08 148/260 |
| 5,073,196 | A * | 12/1991 | Fotinos | C23C 22/361 106/287.19 |
| 5,236,741 | A * | 8/1993 | Zwiener | C08G 18/3821 427/385.5 |
| 5,243,012 | A | 9/1993 | Wicks et al. | |
| 5,623,045 | A | 4/1997 | Zwiener et al. | |
| 2002/0090529 | A1* | 7/2002 | Ueda | C23C 22/361 428/632 |
| 2004/0147648 | A1 | 7/2004 | Corcoran et al. | |
| 2008/0145678 | A1 | 6/2008 | McMurdie et al. | |
| 2009/0068480 | A1 | 3/2009 | Koch et al. | |
| 2009/0255608 | A1* | 10/2009 | Brouwer | C23C 22/365 148/241 |
| 2010/0266855 | A1* | 10/2010 | Zukowski | C08G 18/10 428/425.8 |
| 2012/0177946 | A1 | 7/2012 | Brouwer et al. | |
| 2012/0183806 | A1* | 7/2012 | McMillen | C23C 22/34 428/656 |
| 2013/0157076 | A1* | 6/2013 | Matsuno | C09D 5/08 428/623 |

FOREIGN PATENT DOCUMENTS

| | | | |
|---|---|---|---|
| DE | 10322446 | A1 | 12/2004 |
| EP | 531249 | A1 | 3/1993 |
| EP | 1571237 | A1 | 9/2005 |
| JP | 2003334490 | A | 11/2003 |
| JP | 2005270861 | A | 10/2005 |
| WO | 2010112157 | A1 | 10/2010 |

OTHER PUBLICATIONS

European Patent Office, European Extended Search Report for Application No. 14189269.5, dated Mar. 6, 2015.

European Patent Office, European Extended Search Report for Application No. 13188842.2, dated Mar. 20, 2014.

Niesten, M., et al. "Custon-made Reactive Thinners", Farbe & Lack, Mar. 2004, p. 94-97, No. 110.

European Patent Office, European Extended Search Report for Application No. 14189269.5, dated Feb. 17, 2016.

* cited by examiner

*Primary Examiner* — Erma Cameron

(74) *Attorney, Agent, or Firm* — Lorenz & Kopf LLP

(57) ABSTRACT

A process for multilayer coating of a metal substrate includes pretreating the metal substrate with an acidic aqueous composition comprising phosphate ions and/or a water-soluble titanium and/or zirconium compound, and water. The pretreated metal substrate optionally is flashed off and a surfacer layer of an organic-solvent based surfacer coating composition is applied. The organic-solvent based surfacer coating composition includes a polyaspartic acid ester, a polyisocyanate cross-linking agent with free isocyanate groups, a pigment and/or extender, and an organic solvent. The surfacer layer is cured.

4 Claims, No Drawings

PROCESSES FOR PRODUCING A MULTILAYER COATING

TECHNICAL FIELD

This technical field relates to processes for producing a multilayer coating on a metal substrate, which may particularly be used for coating and repair coating vehicle bodies and vehicle body parts.

BACKGROUND

Multilayer coatings made up, for example, of a primer, a surfacer, a base coat and a clear coat layer are typical coating structures in vehicle coating and vehicle repair coating. Adhesion of the whole multilayer coating to the substrate is very important. Therefore, primer solutions and undercoat systems are needed with excellent adhesion and corrosion resistance, which are suitable for direct coating of metal substrates.

Currently most of the repair coating processes down to the metal use polyvinylbutyral-based wash primers and two-component polyurethane surfacers in order to achieve acceptable adhesion and good quality of the applied films. A major disadvantage of such processes is insufficient productivity. Normally it takes at least 3 to 4 hours air drying until the surfacer can be sanded and further operations can be started. Sanding after shorter air drying times may lead to films that are still too soft and vulnerable, increasing the risk of damage to the freshly applied paint system. The curing process can be accelerated by using IR radiation or evaluated temperatures. But accelerating the process that way consumes energy and curing equipment needs to be available. Also, adhesion of subsequently applied waterborne basecoats onto two-component polyurethane surfacers with high pigment/extender load is often weak. In addition wash primers generally have a high content of organic solvents, which is not desired for environmental reasons.

A further option is to use fast drying polyurea surface compositions. However, when applying two-component polyurea surfacers directly to metal substrates, specifically to steel and aluminum substrates, adhesion is in general rather weak and adhesion failures are frequently observed. Solutions to improve adhesion of polyurea coating compositions on metals have been disclosed, for example, in WO 2010/112157. WO 2010/112157 discloses a coating composition with low pigment load which can be applied directly to metal surfaces. The coating composition contains polyaspartates and silane-functional polyisocyanates. However, high pigment and extender loads which are needed to ensure good sandability of sanding surfacers can deteriorate adhesion of those compositions to the metal substrate.

Furthermore, DE 10 2006 052 919 discloses a process for conversion pretreatment of metal surfaces, wherein the metallic surfaces are pretreated with a phosphating solution containing phosphate and zinc (II) ions and titanium and/or zirconium compounds. DE 103 22 446 discloses aqueous compositions for anticorrosion conversion pretreatment of metal surfaces. The compositions are based on phosphating solutions and contain in addition water-soluble titanium and zirconium compounds and a quantity of free flouride. The pretreated metals are used, e.g., in automotive construction and shipbuilding.

It has hitherto not been possible to provide productive surfacers with acceptable adhesion to metal substrates or a productive combination of an adhesion primer and a surfacer, which can be sanded after shortened air drying times and which do not simultaneously substantially impair other important coating properties.

Accordingly, it is desirable to provide a process for multilayer coating and multilayer repair coating of metal substrates that increases the productivity under air drying conditions and yields a coating structure with very good corrosion resistance and adhesion properties, e.g. satisfactory wet and dry adhesion to metal substrates as well as interlayer adhesion. It is desirable that Properties of the multilayer coating, such as sandability, drying performance and the productivity of the whole coating process are not impaired as a consequence. Furthermore, other desirable features and characteristics of the various embodiments will become apparent from the subsequent detailed description and the appended claims, taken in conjunction with the accompanying drawings and this background.

SUMMARY

In accordance with an exemplary embodiment, processes for multilayer coating of metal substrates, in particular for multilayer repair coating of metal substrates, comprise the following steps:

pretreating the metal substrate to be coated or repair coated with an acidic aqueous composition comprising:

phosphate ions and/or a water-soluble titanium and/or zirconium compound; and water;

optionally subjecting the pretreated metal substrate to a flash-off phase, applying a surfacer layer of an organic-solvent based surfacer coating composition comprising:

a polyaspartic acid ester;

a polyisocyanate cross-linking agent with free isocyanate groups;

a pigment and/or an extender; and an organic solvent; and curing the surfacer layer.

Surprisingly it has been found that the disadvantages of the prior art solutions can be overcome when applying the above defined aqueous composition in combination with organic-solvent based polyurea surfacers. In prior experiments, a substantially enhanced productivity under air drying conditions—without the need to apply heat—has been achieved. Only 80 minutes after having started the repair coating process sanding of the surface of the surfacer layer was possible. At the same time high end quality and durability as well as good adhesion to the metal substrate and to subsequently applied coating layers, in particular to waterborne basecoats, have been achieved. In particular the adhesion problems of polyurea surfacers alone and in combination with wash primers for direct to metal repair were solved.

DETAILED DESCRIPTION

The following detailed description is merely exemplary in nature and is not intended to limit the present disclosure or the application and uses of the present disclosure. Furthermore, there is no intention to be bound by any theory presented in the preceding background or the following detailed description.

It will be appreciated that certain features which are, for clarity, described above and below in the context of separate embodiments may also be provided in combination in a single embodiment. Conversely, various features that are, for brevity, described in the context of a single embodiment may also be provided separately or in any sub-combination. In addition, references in the singular may also include the plural (for example, "a" and "an" may refer to one, or one or more) unless the context specifically states otherwise.

The term (meth)acrylic as used here and hereinafter should be taken to mean methacrylic and/or acrylic.

Unless stated otherwise, all molecular weights (both number and weight average molecular weight) referred to herein are determined by GPC (gel permeation chromatographie) using polystyrene as the standard and tetrahydrofurane as the liquid phase eluent.

Water-based coating compositions are coating compositions wherein water is used as solvent or thinner when preparing and/or applying the coating composition. Usually, water-based coating compositions may contain, for example, about 30 to about 90% by weight of water, based on the total amount of the coating composition and optionally, up to about 30% by weight, preferably, below about 15% by weight of organic solvents, based on the total amount of the coating composition.

Organic solvent-based coating compositions are coating compositions wherein organic solvents are used as solvents or thinners when preparing and/or applying the coating composition. Usually, solvent-based coating compositions contain, for example, about 20 to about 90% by weight of organic solvents, based on the total amount of the coating composition.

Primers are defined as coating compositions forming the first coating layer of a coating system and function as adhesion promoter between the substrate and the coating system. Primers are applied in very thin coating layers of, e.g., about 2 to about 8 μm (see, for example, definition in "Vehicle Refinishing", Fritz Sadowski).

Surfacers are defined as filled coating compositions forming the contact to the top coat layer. They create adhesion to the top coat, contribute to corrosion protection, fill in unevennesses and prevent "sinkage" of the top coat and marking of substrate surface differences. Surfacers are applied in coating layers of, e.g., about 40 to about 400 μm (see, for example, definition in "Vehicle Refinishing", Fritz Sadowski).

The term "pretreatment composition" shall be used here and in the following for the acidic aqueous composition as defined above.

The individual steps of the process contemplated herein are explained in greater detail below.

Metal substrates are in particular vehicle bodies and vehicle body parts. Suitable metal substrates are, e.g., the metal substrates known in the automotive industry, such as for example iron, zinc, aluminium, magnesium, stainless steel or the alloys thereof.

In first step of the process contemplated herein, the metal substrate to be coated or repair coated is pretreated with the pretreatment composition. In particular in case of a repair coating process the blemished area to be repair coated, e.g., on a vehicle body or vehicle body part, can be prepared in conventional manner, if necessary, before pretreating the metal substrate with the pretreatment composition. The blemished area and optionally also the bordering transition zone between the blemished area and the intact existing coating may, for example, be prepared by cleaning, sanding and re-cleaning. The sanded repair surface can be cleaned with conventional cleaning agents, for example, low VOC surfacer cleaners or silicone removers. After the optional preparation step the metal substrate is pretreated with the pretreatment composition comprising a) phosphate ions and/or b) water-soluble titanium and/or zirconium compounds, and c) water.

Preferably the pretreatment composition comprises about 1 to about 25% by weight, more preferred about 1 to about 16% by weight, relative to the total amount of the pretreatment composition, of phosphate ions, and/or about 0.3 to about 3% by weight, more preferred about 0.5 to about 1% by weight, relative to the total amount of the pretreatment composition, of the at least one water-soluble titanium and/or zirconium compound, calculated as elemental titanium and zirconium. Phosphate ions can be present, for example, in form of dissociated ortho-phosphoric acid and/or ortho-phosphoric acid salts, such as ammonium hydrogen phosphates.

Water-soluble titanium and/or zirconium compounds can be, for example, titanium or zirconium containing complex fluoro acids, such as hexafluoro titanium acid and hexafluoro zirconium acid as well as fluoro complexes of titanium or zirconium, such as hexafluoro titanates or hexafluoro zirconates, such as di-potassium hexafluoro zirconate, di-sodium hexafluoro zirconate, ammonium hexafluoro zirconate, magnesium hexafluoro zirconate, di-lithium hexafluoro zirconate and the analogous titanium complexes. The water-soluble titanium and/or zirconium compounds can be used alone or in combination with one another.

In an exemplary embodiment, the pretreatment composition has a pH value of <7, preferably of about 1 to about 4.

The pretreatment composition can contain about 30 to about 99% by weight of water.

The pretreatment composition can further contain additional ingredients, for example, compounds acting as sources of free fluoride, such as hydrofluoric acid, H2SiF6 and KF, oxidizing agents or accelerators such as H2O2, HNO2, HNO3 and HClO4, additional metal ions such as Zn(II), Mn(II) and Ni(II) and organic solvents such as butyl glycol. Even if not preferred, Cr6+ ions can also be present in the pretreatment composition. Examples of additional ingredients are described in EP 1571237, and DE 10322446.

The phosphate ions and the water-soluble titanium and/or zirconium compound can be called as active ingredients of the pretreatment composition. The pretreatment composition can contain as active ingredient the phosphate ions alone or the water-soluble titanium and/or zirconium compound alone or a combination of both. According to one embodiment the pretreatment composition contains phosphoric acid, according to another embodiment the pretreatment composition contains hexafluoro titanium and/or hexafluoro zirconium acid, and according to yet another embodiment the pretreatment composition contains a mixture of phosphoric acid and hexafluoro titanium acid and/or hexafluoro zirconium acid.

The pretreatment composition can be applied in various ways. One option is to apply it by spraying. A further option is applying the pretreatment composition by wiping, e.g., with a cloth soaked in the pretreatment composition. After application of the pretreatment composition a metal oxide conversion layer is formed on the metal substrate surface. Typically the metal oxide conversion layer is very thin and has a layer thickness of <1 μm.

Suitable cloths to be used for wiping are, for example, those available under the tradename Sontara® from DuPont or any other cleaning tissues to be disposed of after use.

Suitable pretreatment compositions are also commercially available, for example, under the trade name 5717S from DuPont® Refinish (phosphoric acid based). Suitable cloths soaked in the pretreatment composition are also commercially available, for example, under the trade name Auto-Prep™ Pretreatment Wipes from Akzo Nobel or under the trade name Bonderite® 1455-W Wipes from Henkel.

After pretreatment of the metal substrate with the pretreatment composition a flash-off phase is preferably provided in order to allow the solution to form the metal oxide conversion layer and to evaporate water and optionally present organic solvents. For example, a flash-off phase of about 1 to about 2 minutes at about 20 to about 23° C. may be provided. Flashing off may be accelerated with warm air. A rinsing step with water or with other special solutions for surface post treatment or passivation can be included, which may help to further enhance adhesion and corrosion protection of the paint system. Special solutions are, e.g., products commercially available from DuPont® Refinish under the product name 5718S.

In the third step of the process contemplated herein, a surfacer layer of an organic-solvent based surfacer coating composition is applied onto the pretreated metal substrate. The surfacer coating composition comprises A) a polyaspartic acid ester, B) a polyisocyanate cross-linking agent with free isocyanate groups, C) a pigment and/or an extender, and D) an organic solvent.

The surfacer coating composition is a two-component coating composition, i.e., the components that are reactive towards one another, namely the polyaspartic acid ester (A) and the polyisocyanate cross-linking agent (B), are be stored separately from one another prior to application in order to avoid a premature reaction. Generally component (A) and polyisocyanate component (B) may only be mixed together shortly before application. The term "shortly before application" is well-known to a person skilled in the art. The time period within which the ready-to-use coating composition may be prepared prior to the actual use/application depends, e.g., on the pot life of the coating composition. Compositions with very short potlife may be applied by two-component spray guns, where the reactive components are separately fed into a static mixer and applied directly afterwards.

Component (A) of the Surfacer Coating Composition

The polyaspartic acid ester is preferably a compound of Formula (I):

Formula (I)

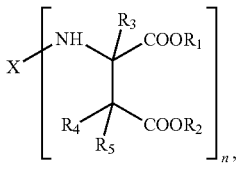

wherein X represents an n-valent organic group, preferably a divalent hydrocarbon group, obtained by removal of the amino groups from a primary polyamine or polyetheramine; $R_1$ and $R_2$ are the same or different organic groups which are inert towards isocyanate groups. $R_3$, $R_4$ and $R_5$ are the same or different and represent hydrogen or organic groups which are inert towards isocyanate groups, and n represents an integer with a value of at least 2, preferably 2 to 4 and more preferably 2. X preferably represents a divalent hydrocarbon group obtained by removal of the amino groups from the primary polyamines and polyetheramines specified below and more preferably represents a divalent hydrocarbon group obtained by removal of the amino groups from the preferred primary polyamines specified below. $R_1$ and $R_2$ are the same or different organic groups and are preferably methyl, ethyl or n-butyl and $R_3$, $R_4$ and $R_5$ are preferably hydrogen.

An organic group which is inert towards isocyanate groups is an organic group which is inert towards isocyanate groups at a temperature of 150° C. or less, e.g. 110° C. or less. Polyaspartic acid esters of Formula (I) are prepared in known manner by reacting the corresponding primary polyamines or polyether amines corresponding to the formula $X—(NH_2)_n$ with optionally substituted maleic or fumaric acid esters corresponding to the formula $R_1OOC—CR_3=CR_4—COOR_2$. X, $R_1$, $R_2$, $R_3$, $R_4$ and n have the meaning as defined above for Formula (I).

Primary polyamines or polyether amines are preferred for preparing the polyaspartic acid esters as those give a favorable solids/viscosity ratio in order to meet a desired VOC of 3.5 lbs/gal (420 grams/liter) or below of the final surfacer formulation. A molar excess of the polyamines or polyether amines can also be reacted with di- and polyisocyanates to prepare amine terminated ureas or polyether ureas, or can be reacted with isocyanate terminated polyesters, polycarbonates or polyethers obtained from the corresponding polyester, polycarbonate or polyether di- or polyols, and subsequent conversion of the terminal amino groups into an aspartic acid ester through reaction with a maleic and/or fumaric acid ester.

Suitable primary polyamines include ethylene diamine, 1,2-diaminopropane, 1,4-diaminobutane, 1,3-diaminopentane, 1,6-diaminohexane, 2,5-diamino-2,5-dimethylhexane, 2,2,4- and 2,4,4-trimethyl-1,6-diaminohexane, 1,11-diaminoundecane, 1,12-diaminododecane, 1,3- and 1,4-cyclohexane diamine, 1-amino-3,3,5-trimethyl-5-aminomethylcyclohexane, 2,4- and 2,6-hexahydrotoluylene diamine, 2,4'- and 4,4'-diaminodicyclohexyl methane and 3,3'-dialkyl-4,4'-diaminodicyclohexylmethanes, such as 3,3'-dimethyl-4,4'-diaminodicyclohexyl methane and 3,3'-diethyl-4,4'-diaminodicyclohexylmethane, 2,4,4'-triamino-5-methyldicyclohexylmethane, 2-methyl-1,5-pentanediamine and 1,3- and 1,4 xylylenediamine. Preferred primary polyamines are amino-3,3,5-trimethyl-5-aminomethylcyclohexane (IPDI), 2,4'- and 4,4'-diaminodicyclohexyl methane, 3,3'-dialkyl-4,4'-diaminodicyclohexylmethanes such as 3,3'-dimethyl-4,4'-diaminodicyclohexyl methane and 2-methyl-1,5-pentanediamine.

Suitable polyether polyamines are those with aliphatically bonded primary amino groups. The polyether polyamines can have a molecular weight of about 148 to about 6,000. Examples of suitable polyether polyamines are the products commercially available under the trademark JEFFAMINE® from Huntsman.

Examples of optionally substituted maleic or fumaric acid esters suitable for preparing the polyaspartic acid esters include the dimethyl, diethyl, dibutyl (e. g. di-n-butyl, di-s-butyl, di-t-butyl), diamyl, di-2-ethylhexyl esters and mixed esters based on mixtures of the above groups and/or other alkyl groups; and the corresponding maleic and fumaric acid esters substituted by methyl in the 2- and/or 3-position. The dimethyl, diethyl and dibutyl esters of maleic acid are preferred, while the diethyl esters are especially preferred.

Other diesters which can be used are those derived from cycloaliphatic, bicycloaliphatic and aromatic alcohols, such as cyclohexanol, benzylalcohol and isoborneol. Long chain monoalcohols such as ether alcohols can also be used, e.g., the reaction products of monoalkyl, cycloalkyl and aryl monoalcohols with ethyleneoxide, propyleneoxide, butyleneoxide, such as monobutylglycol, monohexylglycol, propyleneglycol monobutylether. The preparation of polyaspartic acid esters of Formula (I) from the above mentioned starting materials may be carried out, for example, at a temperature of from 0 to about 150° C. using the starting materials in such proportions that at least one, preferably one, olefinic double bond is present for each primary amino group. Excess of starting materials may be removed by distillation after the reaction. The reaction may be carried out solvent-free or in the presence of suitable organic solvents.

Component (B) of the Surfacer Coating Composition

The surfacer coating composition also comprises a polyisocyanate cross-linking agent with free isocyanate groups. The polyisocyanates can be any number of organic polyisocyanates with aliphatically, cycloaliphatically, araliphatically and/or aromatically bound free isocyanate groups. The polyisocyanates are liquid at room temperature or become liquid through the addition of organic solvents. At 23° C., the polyisocyanates generally have a viscosity of about 1 to about 3,500 mPas, preferably of about 5 to about 3,000 mPas.

The preferred polyisocyanates are polyisocyanates or polyisocyanate mixtures with exclusively aliphatically and/or cycloaliphatically bound isocyanate groups with an average NCO functionality of about 1.5 to about 6, preferably about 2 to about 6.

Examples of particularly suitable polyisocyanates are what are known as "paint polyisocyanates" based on hexamethylene diisocyanate (HDI), 1-isocyanato-3,3,5-trimethyl-5-isocyanatomethyl-cyclohexane (IPDI) and/or bis (isocyanatocyclohexyl)-methane and their derivatives. Typically, following production, the derivatives are freed from surplus parent diisocyanate, preferably by distillation, with only a residue content of less than about 0.5% by weight. Triisocyanates, such as triisocyanatononan can also be used.

Sterically hindered polyisocyanates are also suitable. Examples of these are 1,1,6,6-tetramethyl-hexamethylene diisocyanate, 1,5-dibutyl-penta-methyldiisocyanate, p- or m-tetramethylxylylene diisocyanate and the appropriate hydrated homologues. In principle, diisocyanates can be converted by the usual processes to higher functional compounds, for example, by trimerization or by reaction with water or polyols, such as, for example, trimethylolpropane or glycerine. The polyisocyanates can also be used in the form of isocyanate-modified resins or isocyanate-functional pre-polymers. Generally the polyisocyanates can be isocyanurates, uretdione diisocyanates, biuret group-containing polyisocyanates, urethane group-containing polyisocyanates, allophanate group-containing polyisocyanates, isocyanurate and allophanate group-containing polyisocyanates, carbodiimide group-containing polyisocyanates and polyisocyanates containing acylurea groups.

The polyisocyanate cross-linking agents can be used individually or in combination with one another. The polyisocyanate cross-linking agents are those commonly used in the paint industry. They are described in detail in the literature and are also commercially obtainable. The isocyanate groups of polyisocyanate crosslinking agent B) may be partially blocked. Low molecular weight compounds containing active hydrogen for blocking NCO groups are known. Examples of those blocking agents are aliphatic or cycloaliphatic alcohols, dialkylamino alcohols, oximes, lactams, imides, hydroxyalkyl esters and esters of malonic or acetoacetic acid.

Surfacer Coating Composition

In addition to components A) and B) the surfacer coating composition contains a pigment and/or extender and at least one organic solvent. The organic solvents may originate from the preparation of the binders or they may be added separately. They are organic solvents typically used for coating compositions and well known to the skilled person. The pigments and extenders can be any conventional organic and/or inorganic color-imparting pigments and extenders as are known to the person skilled in the art for the production of coating compositions, in particular for the production of surfacer coating compositions in the vehicle coating sector. Examples of pigments are titanium dioxide, micronized titanium dioxide, iron oxide pigments, carbon black, azo pigments, phthalocyanine pigments, quinacridone and pyrrolopyrrole pigments. Examples of extenders are silicon dioxide, aluminium silicate, aluminium oxide, carbonates, barium sulphate, kaolin and talcum.

The surfacer coating compositions generally have a weight ratio of extenders and pigments to binder solids of preferably about 4.0:1.0 to about 1.0:2.0, particularly preferably, of about 3.0:1.0 to about 1.5:1.0. The pigment volume concentration (PVC) is, for example, in the range of about 20 to about 65% for surfacer coating compositions in general and in the range of about 35 to about 55% for sanding surfacer coating compositions. The PVC is the ratio of volume of pigments/extenders to total volume of all non-volatile components of the composition (including pigments/extenders, binders, additives etc.) in percent.

The surfacer coating composition may also contain additives. The additives are the conventional additives, which may be used, in the coating sector. Examples of such additives typical for use in surfacer coating compositions include levelling agents, e.g., based on (meth)acrylic homopolymers or silicone oils, anti-cratering agents, anti-foaming agents, wetting agents, curing catalysts for the cross-linking reaction, dispersing agents, thickeners, emulsifiers and water scavengers. The additives are used in usual quantities known to a skilled person.

According to one embodiment the surfacer coating composition comprises a compound containing an alkoxy silane group and an epoxy group (epoxy silane compound). The epoxy silane compound can be a monomeric, oligomeric or polymeric compound. Examples of suitable monomeric oligomeric or polymeric epoxy silane compounds are those having at least one alkoxy silane group corresponding to Formula (II):

Formula (II)

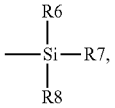

wherein R6, R7, R8 are the same or different organic groups with 1 to 30 carbon atoms per molecule, provided that at least one of the residues R6, R7 and R8 is an alkoxy group with 1 to 4 carbon atoms.

Monomeric, polymeric and oligomeric alkoxy silane compounds contain in addition to the alkoxy silane group at least one epoxy group. The epoxy silane compound is preferably a monomeric compound, more preferred a compound of the general Formula (III):

Formula (III)

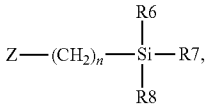

wherein Z represents the residues

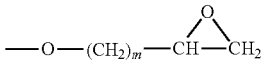

with m being 1-4; or represents 3,4-epoxycyclohexyl; R6, R7, R8 are the same or different organic residues with 1 to 30 carbon atoms, provided that at least one of the residues R6, R7 and R8 is an alkoxy group with 1 to 4 carbon atoms; and n is 2, 3 or 4, preferably 2 or 3.

Preferred compounds of the formula (III) are those in which Z is

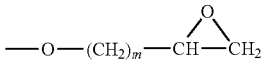

with m being 1 to 4.

Compounds in which R6, R7 and R8 are the same or different alkoxy groups having 1 to 4, preferably 1, 2 or 3 carbon atoms are likewise preferred. Particularly preferred alkoxy groups are methoxy, ethoxy and isopropoxy groups.

Examples of particularly suitable epoxy-functional silane compounds of the general formula (III) are (3-glycidoxypropyl)trimethoxysilane, (3-glycidoxypropyl)triethoxysilane, (3-glycidoxypropyl)triisopropoxysilane, beta-(3,4-epoxycyclohexyl)ethyltrimethoxysilane and beta-(3,4-epoxycyclohexyl) ethyltriethoxysilane. Silanes with methoxy groups, such as for example (3-glycidoxypropyl) trimethoxysilane and beta-(3,4-epoxycyclohexyl)ethyltrimethoxy-silane are particularly preferred here.

Epoxy silane compounds of Formula (III) which may be used are also obtainable as commercial products, for example under the trade name DYNASILAN® Glymo from Degussa, SILQUEST® A187 and SILQUEST® A186 from ACC Silicones.

Examples of polymeric epoxy silane compounds are (meth)acrylic copolymers with at least one alkoxy silane group and at least one epoxy group.

The epoxy silane compounds, specifically the preferred compounds of Formula (III) can be used in amounts of about 0.25 to about 5.0% by weight solids, in particular of about 0.8 to about 3.0% by weight solids and most preferred of about 2.0 to about 3.0% by weight solids, relative to the sum of the solids content of component A) and component B).

In principle, the surfacer coating composition can still be adjusted to spray viscosity with organic solvents prior to application. Also a third component can be used as so-called reducer containing solvents and optionally further ingredients like catalysts or other additives. All the further components which are required for producing a usable surface coating composition, such as for example pigments, extenders, organic solvents and additives, may in each case be present in one of the two components, in both components or in the reducer of the two-component system.

Also, the epoxy-functional silane compounds C) may be present in one of the two components or in both components or in the reducer. Most preferred the epoxy-functional silane compounds C) are present in the polyisocyanate component B).

In addition to component A) the surfacer coating composition can comprise other cross-linkable binders, for example cross-linkable binders with functional groups containing active hydrogen. These binders may be oligomeric and/or polymeric compounds with a number average molecular weight (Mn) of, e.g., about 500 to about 200,000 g/mole, preferably of about 1100 to about 100,000 g/mole. The functional groups with active hydrogen can be hydroxyl and/or amino groups.

Binders with hydroxyl groups are for example the polyurethanes, (meth)acrylic copolymers, polyesters and polyethers, known from polyurethane chemistry to the skilled person, which are used in the formulation of organic solvent based coating compositions. They may each be used individually or in combination with one another.

Examples of additional binders or reactive diluents with amino groups are, for example, oligomeric or polymeric blocked amines, such as oligomeric or polymeric ketimines and/or aldimines. Suitable ketimines and aldimines are disclosed, for example, in FARBE&LACK 3/2004, page 94-97, in DE4415778 or in EP 0531249. The surfacer coating composition to be used in the process contemplated herein can comprise about 4 to about 40% by weight solids, preferably about 4 to about 20% by weight solids, relative to the total amount of the surfacer coating composition, of the at least one polyaspartic acid ester A). The surfacer coating composition can also comprise up to about 20% by weight, relative to the total amount of the surfacer coating composition, of the other cross-linkable binders, for example about 1 to about 10% by weight solids, relative to the total amount of the surfacer coating composition. According to one embodiment the surfacer coating composition can comprise about 1 to about 20% by weight solids, relative to the total amount of the surfacer coating composition, of aldimines and/or ketimines.

In vehicle body or vehicle body part coating, specifically in vehicle body or vehicle body part repair coating surfacer coating compositions are preferably applied by means of spraying, onto the substrates.

The surfacer coating compositions are applied, for example, in a resulting dry film thickness of about 25 to about 400 μm and in case of sanding surfacers (before sanding) in a resulting dry film thickness of about 60 to about 250 μm.

The surfacer layer can be cured after application or can be cured together with a subsequently applied coating layer, e.g. a top coat layer. The surface layer may be cured or dried or flashed off before application of the top coat layer. In case of sanding surfacers the surfacer layer can, for example, be dried or cured at room temperature, e.g., within about 40 minutes to about 24 hours, or dried or cured at elevated temperatures of, e.g., about 40 to about 60° C.

In order to provide a full repair multilayer coating the surfacer layer is typically over-coated with a top coat. The top coat layer can be formed by applying a base coat layer of a base coat coating composition containing color-imparting and/or special effect-imparting pigments, preferably of a water-based base coat coating composition, and a clear coat layer of a transparent clear coat coating composition onto the base coat layer, or can be formed by applying a single-stage top coat layer of a single-stage top coat coating composition containing color-imparting and/or special effect-imparting pigments.

The base coat coating composition contains the conventional constituents of a water-based pigmented base coat coating composition such as: color-imparting and/or special effect-imparting pigments, one or more binders, water and/or organic solvents and optionally crosslinking agents and conventional coating additives.

Once the base coat coating composition has been applied a clear coat coating composition can be applied. The clear coat coating composition may be applied onto the base coat layer either after drying or curing or after briefly flashing off, for example, at room temperature. Preferably the clear coat coating composition comprises a "two-component" coating composition, i.e. comprises components which are reactive towards one another, namely a binder component comprising active hydrogen and a polyisocyanate crosslinking agent. Preferred clear coat coating compositions comprise at least one hydroxyl-functional (meth)acrylate resin, optionally in combination with at least one hydroxyl-functional oligomeric polyester and at least one polyisocyanate. The clear coating compositions may contain usual coating additives and organic solvents.

Alternatively a single-stage top coat layer of a pigmented single-stage top coat composition can be applied onto the surfacer layer. The single-stage top coat coating composition contains conventional coating pigments, for example, effect-imparting pigments and/or color-imparting pigments selected from among white, colored and black pigments. Preferably the single-stage top coat coating composition comprise a "two-component" coating composition, i.e. comprises components which are reactive towards one another, namely a binder component comprising active hydrogen and a polyisocyanate crosslinking agent.

The resultant two-layer or single-stage top coat layers may be cured at room temperature or forced at higher temperatures, for example, of up to about 80° C., preferably at about 40 to about 60° C. The coating compositions are applied by conventional processes, preferably by means of spray application.

The process contemplated herein can be used in automotive and industrial coating, however, particularly advantageously in vehicle repair coating.

The process contemplated herein will be explained in more detail on the basis of the examples below. All parts and percentages are on a weight basis unless otherwise indicated.

EXAMPLES

Example 1

Preparation of Pretreatment Compositions

Pretreatment compositions 1.1 and 1.2 are prepared with the ingredients shown in Table 1.

TABLE 1

| | Example 1.1 | Example 1.2 |
|---|---|---|
| Demineralized water | 79% | 77.9% |
| Butyl glycol | 1% | 1% |
| $H_3PO_4$: 85% solution in water | | 1.1% |
| $H_2TiF_6$: 5% solution in water | 20% | 20% |
| Sum | 100% | 100% |

In addition commercially available pretreatment composition 1.3 and pretreatment wipes 1.4 and 1.5 have been used:

Example 1.3

5717S—Phosphoric Acid Based Metal Conditioner from DuPont Refinish

Example 1.4

AutoPrep™ Pretreatment Wipes from Akzo Nobel

Example 1.5

Bonderite® 1455-W Wipes from Henkel

Example 2

Preparation of a Surfacer Coating Compositions

Surfacer coating compositions 2.1 and 2.2 have been prepared with the ingredients shown in Tables 2 and 3.

TABLE 2

(Example 2.1)

| | % by weight |
|---|---|
| Component A | |
| POLYASPARTIC ACID ESTER (1) | 14.8 |
| 1-METHOXY-2-PROPYLACETATE | 3.5 |
| BUTYL ACETATE | 5.0 |
| WETTING ADDITIVE (2) | 0.8 |
| RHEOLOGY ADDITIVE (3) | 0.4 |
| IRONOXIDE BLACK | 0.9 |
| $TiO_2$ | 6.5 |
| CALCIUMCARBONATE | 32.7 |
| ZINKPHOSPHATE | 6.1 |
| Additions after dispersion step | |
| BUTYL ACETATE | 5.2 |
| LEVELLING ADDITIVE | 1.1 |
| SUM | 77.1 |
| Component B | |
| POLYISOCYANATE (4) | 15.9 |
| Reducer | |
| BUTYL ACETATE | 7.0 |
| SUM | 100.0 |

TABLE 3

(Example 2.2)

| | % by weight |
|---|---|
| Component A | |
| POLYASPARTIC ACID ESTER (1) | 12.8 |
| SOLVENT MIX (5) | 8.8 |
| WETTING ADDITIVE (2) | 0.4 |
| IRONOXIDE BLACK | 1.1 |
| $TiO_2$ | 10.9 |
| BARIUMSULFATE | 21.9 |

TABLE 3-continued

| (Example 2.2) | |
|---|---|
| | % by weight |
| TALCUM | 3.6 |
| KAOLIN | 6.6 |
| ZINKPHOSPHATE | 5.8 |
| Additions after dispersion step | |
| SOLVENT MIX (5) | 13.1 |
| SUM | 85.0 |
| Component B | |
| POLYISOCYANATE (4) | 15.0 |
| SUM | 100.0 |

(1) Desmophen® NH 1420 from Bayer (2) Antiterra® 203 from Byk (3) Bentone® 38 from Elementis Specialties (4) Desmodur® 3900 60% in butyl acetate from Bayer (5) 1/1/1 mixture of butyl acetate, methoxypropyl acetate and xylene The surfacer coating compositions are highly filled compositions with a PVC of 40%.

Example 3

Application

Steel, galvanized steel and aluminum panels have been prepared for the coating process by degreasing, sanding and cleaning according to the typical preparation procedures known by a person skilled in the art.

The commercial pretreatment composition and the commercial wipes have been applied and used according to the technical datasheets of the commercial products.

The non-commercial pretreatment compositions have been wiped on the metal surface in a way that flash-off times until full drying of the surface took roughly 1 minute.

The surfacer coating compositions have been applied 5-10 minutes after flash-off of the pretreatment composition. The surfacer layers have been cured at around 50% humidity for 1 hour at room temperature and have been sanded afterwards.

The surfacer layers were very hard and sandability was very well. The time of application of the whole application process until sanding was about 80 minutes.

After sanding the panels have been cleaned and overcoated with a commercially available refinish waterborne basecoat (Permahyd Hi-Tec Base Coat 480 in RAL5010 from Spies Hecker) and a refinish solventborne clearcoat (Permasolid HS Clearcoat 8055 from Spies Hecker).

After 7 days storage of the test panels at room temperature humidity tests (240 h, 40° C., 100% humidity according to DIN EN ISO 6270) have been carried out. Cross hatches have been done according to DIN EN ISO 2409 (2 mm distance of scribes, pull off with Tesa 4657 tape).

Test results of surfacer example 2.1 applied on the steel panels with and without pretreatment and with application of a wash primer and over-coated with base coat and clear coat are shown in Table 4. Priomat® 1K wash primer 4085 from Spiess Hecker GmbH has been used.

TABLE 4

| Substrate/pretreatment | direct to steel | steel with wash primer | steel with example 1.4 |
|---|---|---|---|
| Dry adhesion before humidity test | GT 5* | GT 1 | GT 0 |
| Wet adhesion 1 h after 240 h humidity stress | GT 5*" | GT 5* | GT 3** |
| Recovery after additional 24 h | GT 5*" | GT 5* | GT 3** |

*splits between the metal and the surfacer layer or cohesion failure within the wash primer

**splits between the surfacer and the basecoat layer or cohesion failure within the basecoat layer "large area delaminations Test results of surfacer example 2.2 applied on the steel panels with and without pretreatment and over-coated with base coat and clear coat are shown in Table 5.

TABLE 5

| Substrate/pretreatment | direct to steel | steel/ example 1.1 | steel/ example 1.2 | steel/ example 1.3 | steel/ example 1.5 |
|---|---|---|---|---|---|
| Dry adhesion before humidity test | GT 4-5* | GT 0-1 | GT 0 | GT 0-1 | GT 0-1 |
| Wet adhesion 1 h after 240 h humidity stress | GT 5*" | GT 0-1 | GT 1-2 | GT 0-1 | GT 1 |
| Recovery after additional 24 h | GT 5*" | GT 0 | GT 0 | GT 0 | GT 0 |

*splits between the metal and the surface layer

"large area delaminations

Test results of surfacer example 2.2 applied on the steel and aluminum panels with and without pretreatments and without over-coating with basecoat and clear coat are shown in Table 6.

TABLE 6

| Substrate/pretreatment | direct to steel | steel/example 1.1 | steel/example 1.5 |
|---|---|---|---|
| Dry adhesion before humidity test | GT 1 | GT 1 | GT 0-1 |
| Wet adhesion 1 h after 240 h humidity stress | GT 5*" | GT 1 | GT 0-1 |
| Recovery after additional 24 h | GT 5*" | GT 1-2 | GT 1 |
| **Substrate/pretreatment** | **direct to aluminum** | **aluminum/ example 1.1** | **aluminum/ example 1.5** |
| Dry adhesion before humidity test | GT 5* | GT 0 | GT 0 |

*splits between the metal and the surfacer layer

"large area delaminations

The above results demonstrate the weak adhesion properties of polyurea surfacers directly applied to metals, which cannot sufficiently be improved by the use of wash primers. The new application process as contemplated herein provides the desired combination of high productivity, very good adhesion and corrosion protection and in addition the reduction of volatile organic compounds.

While at least one exemplary embodiment has been presented in the foregoing detailed description, it should be appreciated that a vast number of variations exist. It should also be appreciated that the exemplary embodiment is only an example, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

The invention claimed is:

1. A process for multilayer coating of a metal substrate, the process comprising the steps of:

pretreating the metal substrate to be coated with an acidic aqueous composition comprising:

a) phosphate ions comprising ammonium hydrogen phosphate, b) a water-soluble titanium compound selected from the group consisting of: a hexafluoro titanium acid or a hexafluoro titanate, and optionally c) a zirconium compound selected from the group consisting of: a hexafluoro zirconium acid or a hexafluoro zirconate, wherein the acidic aqueous composition comprises about 1 to about 16% by weight, relative to the total amount of the acidic aqueous composition, of phosphate ions and about 0.5 to about 1% by weight, relative to the total amount of the acidic aqueous composition, of the water-soluble titanium and, if present, zirconium compound, calculated as elemental titanium and zirconium, and wherein the acidic aqueous composition has a pH value of about 1 to about 4; and water in an amount of about 30% to about 99% by weight, relative to the total amount of the acid aqueous composition;

subjecting the metal substrate to a flash-off phase to form a metal oxide conversion layer on the metal substrate, said flash-off phase being performed for a time period of about 1 minute to about 2 minutes at a temperature of about 20 to about 23 degrees Celsius;

applying a surfacer layer of an organic-solvent based surfacer coating composition comprising:

a polyaspartic acid ester of formula I:

Formula (I)

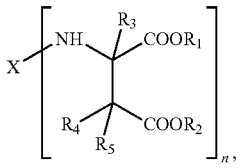

wherein X represents an n-valent organic group, obtained by removal of the amino groups from a primary polyamine or polyetheramine; $R_1$ and $R_2$ are the same or different organic groups which are inert towards isocyanate groups, $R_3$, $R_4$ and $R_5$ are the same or different and represent hydrogen or organic groups which are inert towards isocyanate groups, and n represents an integer with a value of at least 2, wherein the organic-solvent based surfacer coating composition comprises about 5 to about 60% by weight, relative to the total amount of the organic-solvent based surfacer coating composition, of the polyaspartic acid ester;

a polyisocyanate cross-linking agent with free isocyanate groups, wherein the cross-linking agent consists of aliphatically and/or cycloaliphatically bound isocyanate groups with an average NCO functionality of about 2 to about 6;

at least one epoxy-functional silane compound chosen from (3-glycidoxypropyl)trimethoxysilane, (3-glycidoxypropyl)triethoxysilane, (3-glycidoxypropyl)triisopropoxysilane, beta-(3,4-epoxycyclohexyl)ethyltrimethoxysilane and beta-(3,4-epoxycyclohexyl) ethyltriethoxysilane at least one aldimine and/or ketimime;

pigments and/or extenders, wherein the organic-solvent based surfacer coating composition has a pigment volume concentration (PVK) of about 20% to about 65%; and an organic solvent, wherein the surfacer layer is applied such that it has a resulting dry film thickness of about 25 to about 400 μm;

curing the surfacer layer;

applying a top coat layer overlying the cured surfacer layer; and curing the top coat layer.

2. The process of claim 1, wherein the acidic aqueous composition is applied by wiping.

3. The process of claim 2, wherein the acidic aqueous composition is applied by wiping with a cloth soaked in the acidic aqueous composition.

4. The process of claim 1, wherein the metal substrate comprises vehicle bodies or vehicle body parts.

* * * * *